US005703547A

United States Patent [19]

Bertin et al.

[11] Patent Number: 5,703,547

[45] Date of Patent: Dec. 30, 1997

[54] DUAL-MODE CAVITY FOR WAVEGUIDE BANDPASS FILTER

[75] Inventors: Giorgio Bertin, Turin; Luciano Accatino, Rosta, both of Italy

[73] Assignee: Cselt- Centro Studi E Laboratori Telecomunicazioni S.P.A., Turin, Italy

[21] Appl. No.: 798,645

[22] Filed: Feb. 11, 1997

Related U.S. Application Data

[63] Continuation of Ser. No. 486,318, Jun. 7, 1995.

[30] Foreign Application Priority Data

Jun. 8, 1994 [IT] Italy ..... TO94A0473

[51] Int. Cl.[6] ..... H01P 1/20

[52] U.S. Cl. ..... 333/209; 333/208; 333/212; 333/230

[58] Field of Search ..... 333/208, 209, 333/212, 248, 252, 230

[56] References Cited

U.S. PATENT DOCUMENTS

| | | | |
|---|---|---|---|
| 3,235,822 | 2/1966 | De Loach, Jr. . | |
| 3,697,898 | 10/1972 | Blachier et al. | 333/209 |
| 4,513,264 | 4/1985 | Dorey et al. | 333/230 |
| 4,544,901 | 10/1985 | Rhodes et al. | 333/208 |
| 4,792,771 | 12/1988 | Siu | 333/212 |
| 5,012,211 | 4/1991 | Young et al. | 333/212 |
| 5,268,659 | 12/1993 | Zaki et al. | 333/212 |
| 5,349,316 | 9/1994 | Sterns | 333/212 |

FOREIGN PATENT DOCUMENTS

| | | |
|---|---|---|
| 28 45 050 | 4/1980 | Germany . |
| 174501 | 9/1985 | Japan . |
| 169501 | 7/1987 | Japan . |

OTHER PUBLICATIONS

Dual Mode Coupling By Square Corner Cut In Resonators And Filters, IEEE Transactions On Microwave Theory And Techniques, vol. 40, No. 12, Dec. 1992 Liang, Et Al (Members Of IEEE).

Narrow–Bandpass Waveguide Filters, IEEE Transactions On Microwave Theory And Techniques, vol. MTT–20, No. 4, Apr. 1972 ATIA, Et Al (Members Of IEEE).

*Primary Examiner*—Robert Pascal
*Assistant Examiner*—Darius Gambino
*Attorney, Agent, or Firm*—Herbert Dubno

[57] ABSTRACT

Dual-mode cavity of waveguide bandpass filters, which allow the realization of narrow-band filters with very limited transition band and extremely low losses, without tuning or coupling screws or smooth edges. The dual mode cavity is composed of three coaxial sections of waveguide arranged in cascade and provided with irises, of which the two end sections are suited to support two modes with orthogonal polarizations and the intermediate section, consisting of a rectangular waveguide, has its side tilted with respect to the plane on which the irises lie. The whole filter composed of these cavities can be entirely designed by means of a computer and requires no tuning operation.

6 Claims, 2 Drawing Sheets

DUAL-MODE CAVITY FOR WAVEGUIDE BANDPASS FILTER

CROSS REFERENCE TO RELATED APPLICATION

This is a file-wrapper continuation of copending application 08/486,318 filed 7 Jun. 1995.

FIELD OF THE INVENTION

Our present invention relates to microwave devices for radio frequency telecommunications systems, including those installed aboard satellites and, more particularly, to a dual mode cavity for a waveguide bandpass filter.

BACKGROUND OF THE INVENTION

Bandpass filters operating at microwave frequencies generally use coupled resonant cavities, made of waveguide sections provided with appropriate coupling irises. The interior volume of the cavities depends on the operating wavelength and it increases as the desired resonance frequency decreases.

The filters are employed as channel filters in both ground and satellite-based telecommunications systems, where it is very important to use devices of limited size and weight. It is therefore necessary to find solutions allowing reduction in the number and dimensions of the cavities so that the filter can be as small as possible.

The filter must also exhibit excellent electrical characteristics. In particular, the transition band of the filter must be as narrow as possible. In that way, a greater number of filters with adjacent central frequencies can be allocated in the same frequency band and a greater number of transmission channels can be used simultaneously.

Among the filters that meet these requirements satisfactorily are certain dual-mode filters. Such filters are advantageous. They are described, for example, in "Narrow-Bandpass Waveguide Filters", by Ali E. Atia et al., IEEE Transactions on Microwave Theory and Techniques, Vol. MTT-20, No. 4, April 1972. These filters use the same cavity twice, once operating on a polarization of the TE10 mode, and another one operating on the orthogonal polarization of the same mode, coupling between the modes being obtained by perturbing the symmetry of the section in the diagonal plane with respect to the orthogonal polarization planes. The resulting effect is equivalent to that obtainable with two ordinary cavities, so that a filter with a desired pass band can be made with half the number of cavities.

Moreover, re-use of the same cavity permits more sophisticated transfer functions than those with all polynomial transmission zeros or zeros at infinity, characteristic of a plurality of simply cascaded cavities. Indeed, re-using the same cavity creates situations in which, by means of suitable irises, it is possible to perform additional couplings between the filter cavities. This allows transfer functions to be obtained with zeros at finite frequency, i.e. to realize elliptical filters or filters with equalized group delay.

Currently known dual mode filters are generally constructed using cavities with circular cross sections and, sporadically, also cavities with square cross sections, which accept two orthogonal linear polarizations of the same resonant mode, having equal dimensions in orthogonal directions. The two modes are usually tuned by means of screws placed at the intersection of the cavity lateral surface with the polarization planes of each mode. Moreover, the modes are coupled to each other, with the desired coupling coefficient, by means of a third screw placed at the intersection of the cavity lateral surface with the diagonal plane with respect to the polarization planes. For reasons of symmetry, each screw may be associated with another screw placed in a diametrically opposite position with respect to the axis of the cavity and in the same cross section.

The tuning of the filter by adjusting the screws, is extremely difficult. The adjustment problem increases with the complexity of the transfer function, i.e. the resonances are present. For example in the case of an eight-pole filter, up to three additional couplings are present, which makes the action at each screw have an impact on several electrical parameters at the same time, among them input reflection and group delay.

In the case of applications of the filter in power stages, such as those where the filter is provided in an output from a transmitter, the presence of screws can be a non-negligible source of passive intermodulation. This is because non-linearity effects, albeit very low, may arise similar to those introduced by diodes as there is not a perfect electrical contact between screw and cavity. Thus, higher order products of the signals present in the filter can be generated and can cause interferences in the reception channels.

More recently, techniques to realize dual mode filters without tuning screws have been presented, for instance, in the article "Dual Mode Coupling by Square Corner Cut in Resonators and Filter" by X. P. Liang and K. A. Zaki, IEEE Transactions on Microwave Theory and Techniques, vol. 40, No. 12, December 1992. In this case, cavities of rectangular cross section are used, in which the sides control the resonance frequency of the two orthogonal modes. Coupling is obtained by suitably smoothing off one of the edges of the cavity. However, it should be noted that modeling a smooth-edged waveguide presents problems of numerical accuracy, associated with the computation of the guide propagation modes. In particular, designing filters for very narrow bands, which actually are better suited for applications aboard satellites, is very difficult. Furthermore, making cavity filters with irregular cross sections entails higher production costs compared to those required using circular or rectangular guides.

OBJECT OF THE INVENTION

It is the principal object of the present invention to provide a dual mode cavity for a waveguide band pass filter which obviates the drawbacks of earlier waveguide filters.

More specifically it is an object of the invention to provide a dual mode cavity which can be designed for complex transfer functions and yet does not require complex adjustment of tuning screws or the like.

SUMMARY OF THE INVENTION

These drawbacks are obviated by the dual mode cavity for waveguide bandpass filters, provided by the present invention, which allows the realization of narrow-band filters, with extremely reduced transition band and very low losses, which has no tuning or coupling screw and does not require the edges to be smoothed off. As a result, the whole filter composed of these cavities can be entirely designed by computer and requires no tuning operation.

In particular the present invention provides a dual mode cavity waveguide bandpass filter, composed of waveguide sections equipped with irises parallel to each other and which allow coupling the cavity modes with external waveguides or coupling between modes in different cavities.

The filter comprises three coaxial sections of waveguide arranged in cascade, in which:

Two end sections are provided and are able to support two modes with linear polarizations that are parallel or perpendicular to the planes in which the irises lie, and an intermediate section is located between the end sections and consists of a waveguide with rectangular cross section, whose side is tilted with respect to the plane in which the irises lie by an appropriate angle.

Stated otherwise, a dual mode cavity for a waveguide band pass filter can comprise:

a first end waveguide section having a first iris lying in a polarization plane of one mode at an end of the first end waveguide section and shaped to support two modes including the one mode and a mode having a polarization plane perpendicular to the one mode, the first iris enabling coupling of the first end waveguide section to an adjoining waveguide;

an intermediate waveguide section coaxial with and aligned with the first end waveguide section at an end thereof opposite the end at which the first iris is provided, the intermediate Waveguide section being of rectangular section with sides tilted at an angle β greater than 0° and less than 90° with respect to the polarization plane of the one mode and of the first iris; and a second end waveguide section coaxial with and aligned with the intermediate waveguide section and adjacent the second end waveguide section opposite the first end waveguide section, the second end waveguide section having a second iris lying in the polarization plane of the one mode and of the first iris at an end of the second end waveguide section opposite the intermediate waveguide section, the second end waveguide section being shaped to support two modes, the second iris enabling coupling of the first end waveguide section to an adjoining waveguide.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
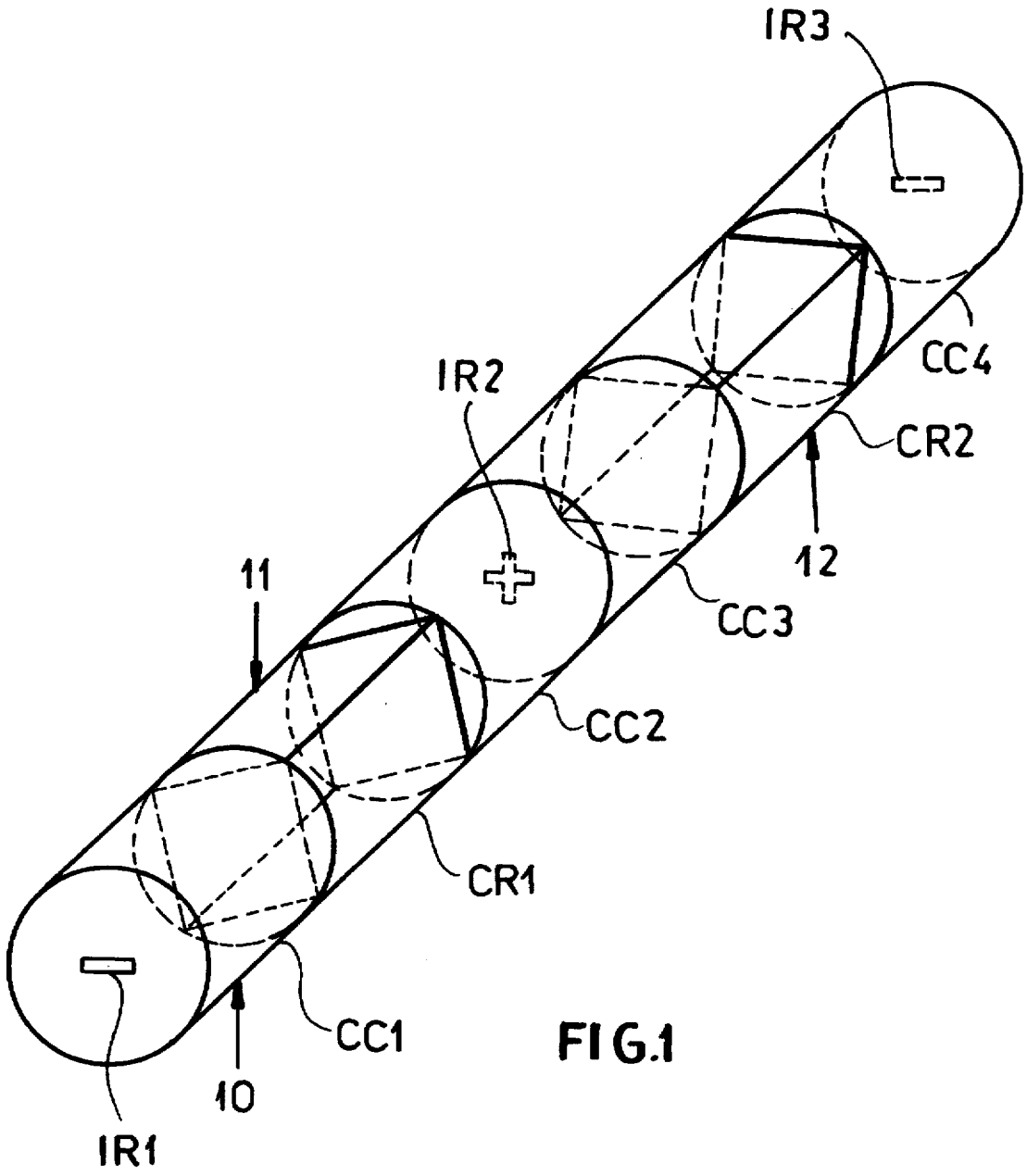
FIG. 1 is a perspective view of a two-cavity filter according to the invention.

FIG. 1 shows in perspective view a bandpass filter 10 comprising two cavities 11, 12 arranged in cascade and with a 4-pole elliptical transfer function. Each cavity 11, 12 is composed of three waveguide sections, arranged in cascade and coaxial, namely, a circular section guide, closed at one end by a circular base, a rectangular-section guide and again a circular-section guide, also closed at one end by a circular base. The first cavity is composed of the three guides respectively denoted by CC1, CR1, CC2, while the second cavity 12 is composed of the three guides respectively denoted by CC3, CR2, CC4.

IR1 and IR3 denote irises, cut in the bases of the circular guide sections and parallel to each other, which allow coupling of the modes in the cavity with external guides. IR2 denotes a cross iris, whose horizontal element is parallel to IR1 and IR3 and which allows coupling between the modes in the two cavities. Direct couplings between the two orthogonal modes in each cavity are obtained by means of the sections CR1 and CR2 of rectangular waveguide whose sides are suitably tilted with respect to the polarization plane of the modes in the sections of circular waveguide, which is determined by the position of irises IR1, IR2, IR3.

Furthermore, the tilt angles of the two sections of rectangular guide can be chosen to obtain appropriate zeros of the transfer function, so as to realize a filter with an elliptical type of transfer function. In this case, the two tilt angles will generally differ.

Figure 2:
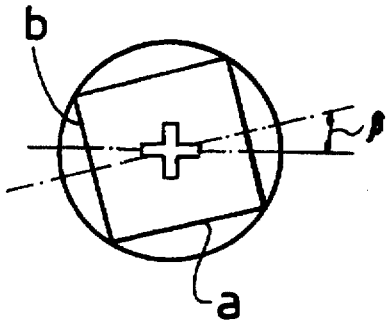
FIG. 2 is a cross section of the cavity at the junction between the circular guide and the tilted regular guide.

FIG. 2 represents the cross section of a cavity in which the rectangular cross section is inscribed in the circular one. The side of the rectangle is tilted by an angle β with respect to the plane of the horizontal element of iris IR2 and in which the irises IR1 and IR3 lie, i.e. the plane of polarization of the mode admitted into the cavity. The amplitude of angle β the lengths of sides "a" and "b" and the length of the rectangular section constitute variables by means of which it is possible to independently set the resonance frequencies of the resonant modes and the degree of coupling.

In particular, the ratio between the lengths of sides "a" and "b" primarily influences the degree of coupling between the mode with horizontal polarization and the mode with vertical polarization in each cavity and angle β primarily influences the tuning of the two resonant modes. It is possible to find a value of β such that the two modes resonate at the same frequency. Advantageously β is between 1° and 89° and preferably between 2° and 88°.

Figure 3:
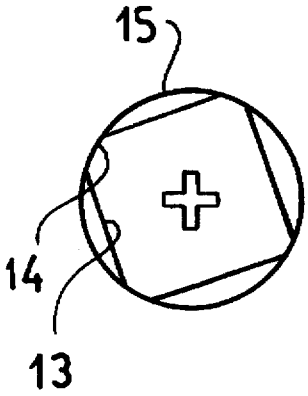
FIG. 3 is a cross section of a second type of cavity.

FIG. 3 represents the cross section of a second type of cavity, in which the rectangular guide is larger than the one that can be inscribed in the circular section, but is smaller than the one that can be circumscribed by the latter.

Figure 4:
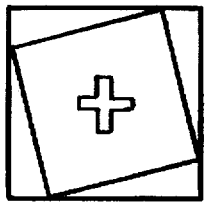
FIG. 4 is a cross section of a third type of cavity.

FIG. 4 represents the cross section of a third type of cavity, in which the sections of circular waveguide are replaced by sections of rectangular waveguide.

All configurations shown FIG. 2, 3 and 4 are suited for a dual mode cavity. The choice of the one which is best suited for the particular application is performed on the basis of mechanical feasibility considerations, as there are no substantial differences in behavior from the electromagnetic point of view.

Figure 5:
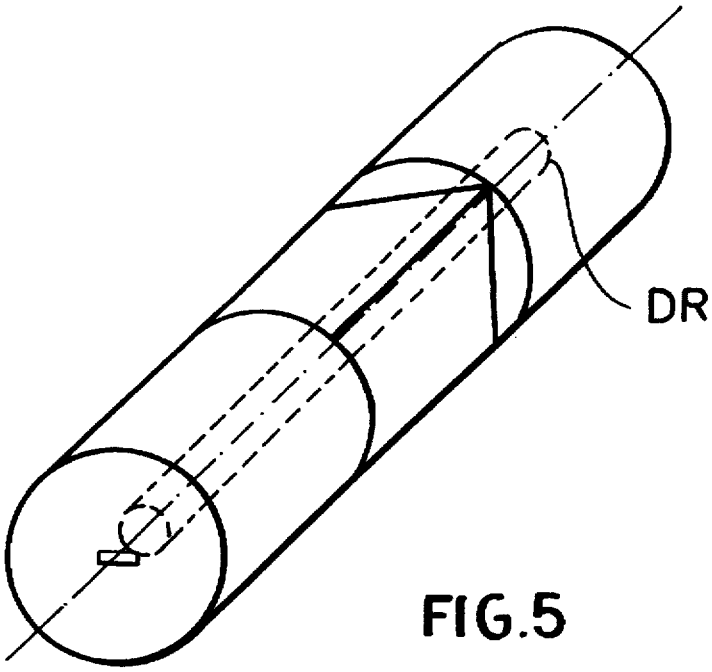
FIG. 5 is a perspective view of a dielectrically charged cavity.

FIG. 5 represents a cavity according to the invention, partially charged with a dielectric cylinder DR, which allows the reduction of the cavity resonance frequency or volume.

Coupling the orthogonal modes by means of a tilted section of guide eases the filter modeling and mechanical fabrication. In particular, extremely accurate computational algorithms exist to analyze the junction between two guides, circular or rectangular, which exhibit a reciprocal tilt angle so that it is possible to obtain, using such algorithms, the complete design of the cavity dimensions, with no further need to tune the device.

The two end sections need not be circular-section waveguides, but can be realized with a square-section or rectangular-section waveguide (in this case the length of the base will be slightly larger than that of the height), since the only characteristics required of these sections of cavity is the capability to support two orthogonal linear polarizations.

The ratio between the cross section area of the tilted guide section and the cross section area of the other two guide sections may optionally be smaller or larger than one.

Moreover, if the rectangular section is larger than the one inscribed in the circular section and smaller than the one circumscribed to the circular section, the tilted rectangular section can be replaced by a rectangular section 13 with edges 14 rounded according to the contour 15 of the circular section.

We claim:

1. A dual-mode cavity for a waveguide bandpass filter, said dual-mode cavity consisting essentially of:

a first end waveguide section having a first iris lying in a polarization plane of one mode at an end of said first end waveguide section and shaped to support two modes including said one mode and a mode having a polarization plane perpendicular to said one mode, said first iris enabling coupling of said first end waveguide section to an adjoining waveguide;

an intermediate waveguide section coaxial with and aligned with said first end waveguide section at an end thereof opposite said end at which said first iris is provided, said intermediate waveguide section being of rectangular section with sides tilted at an angle $\beta$ greater than 0° and less than 90° with respect to said polarization plane of said one mode and of said first iris; and a second end waveguide section coaxial and aligned with said intermediate waveguide section and adjacent said second end waveguide section opposite said first end waveguide section, said second end waveguide section having a second iris lying in said polarization plane of said one mode and of said first iris at an end of said second end waveguide section opposite said intermediate waveguide section, said second end waveguide section being shaped to support two modes, said second iris enabling coupling of said first end waveguide section to an adjoining waveguide, said wave-guide sections forming a single adjustment-screw-free cavity between said irises.

2. The dual-mode cavity for a waveguide bandpass filter as defined in claim 1 wherein each of said first and second end waveguide sections is a circular cross section waveguide section.

3. The dual-mode cavity for a waveguide bandpass filter as defined in claim 1 wherein each of said first and second end waveguide sections is a rectangular cross section waveguide section.

4. The dual-mode cavity for a waveguide bandpass filter as defined in claim 2 wherein said intermediate waveguide section has a rectangular cross section greater than can be inscribed in circular cross sections of said end sections but smaller than a rectangle circumscribing the circular sections with edges rounded to the contours of said circular sections.

5. A waveguide bandpass filter with a dual-mode cavity as defined in claim 1 wherein said dual-mode cavity is in series with another cavity composed of corresponding first and second end waveguide sections and an intermediate waveguide section so that said dual-mode cavity and said other cavity collectively form a bandpass filter with an elliptical transfer function, angles $\beta$ for said intermediate waveguide sections being determined as a function of zeros of the transfer function and an iris coupling modes between said dual-mode cavity and said other cavity is cross shaped.

6. A waveguide bandpass filter comprising a dual-mode cavity as defined in claim 1, further comprising means in said dual-mode cavity for dielectrically charging same.

* * * * *